US007040214B2

(12) United States Patent
Cossette et al.

(10) Patent No.: US 7,040,214 B2
(45) Date of Patent: May 9, 2006

(54) REGENERATION MANIFOLD FOR A HYDRAULIC SYSTEM

(75) Inventors: Marc A. Cossette, Poland, OH (US); John R. Ramun, 8243 N. Lima Rd., Poland, OH (US) 44514

(73) Assignee: John R. Ramun, Poland, OH (US)

( * ) Notice: Subject to any disclaimer, the term of this patent is extended or adjusted under 35 U.S.C. 154(b) by 0 days.

(21) Appl. No.: 10/880,758

(22) Filed: Jun. 30, 2004

(65) Prior Publication Data

US 2006/0000349 A1 Jan. 5, 2006

(51) Int. Cl.
*F15B 11/08* (2006.01)

(52) U.S. Cl. ..... 91/420; 91/436

(58) Field of Classification Search ..... 91/6, 91/420, 436, 437, 440
See application file for complete search history.

(56) References Cited

U.S. PATENT DOCUMENTS 2,800,110 A 7/1957 Haarmeyer
3,071,926 A * 1/1963 Olson et al. ..... 91/420
3,987,705 A 10/1976 Strassheimer et al.
4,147,325 A * 4/1979 McGee ..... 91/437
4,403,431 A 9/1983 Ramun et al.
4,670,983 A 6/1987 Ramun et al.
4,897,921 A 2/1990 Ramun
5,065,664 A * 11/1991 Ohta et al. ..... 91/420
5,415,076 A 5/1995 Krone et al.
5,926,958 A 7/1999 Ramun
5,940,971 A 8/1999 Ramun
5,996,465 A * 12/1999 Morikawa et al. ..... 91/420
6,295,917 B1 * 10/2001 Richardson ..... 91/440
2003/0143085 A1 7/2003 Fletcher et al.

FOREIGN PATENT DOCUMENTS

WO WO 01/28687 4/2001

* cited by examiner

*Primary Examiner*—Thomas E. Lazo
(74) *Attorney, Agent, or Firm*—The Webb-Law Firm

(57) ABSTRACT

A regeneration manifold for a hydraulic system used with a tool attachment on construction and demolition equipment redirects fluid from a reservoir back to the extension chamber to extend the cylinder at a much higher rate when the tool attachment is under little or no load.

19 Claims, 8 Drawing Sheets

REGENERATION MANIFOLD FOR A HYDRAULIC SYSTEM

BACKGROUND OF THE INVENTION

1. Field of the Invention

The present invention relates to a hydraulic system used for tool attachments for construction and demolition equipment, for example, a heavy-duty metal cutting shear, a plate sheer, a concrete crusher, a grapple or other construction and demolition equipment. More particularly, the present invention relates to a regeneration manifold for a hydraulic system.

2. Description of Related Art

For purposes of discussion herein, demolition and construction equipment may also be referred to as scrap handling equipment. The description of demolition equipment and construction equipment herein is not intended to be restrictive of the equipment being referenced. Demolition equipment, such as heavy-duty metal cutting shears, grapples and concrete crushers, are mounted on backhoes powered by hydraulic cylinders for a variety of jobs in the demolition field. This equipment provides for the efficient cutting and handling of scrap. For example, in the dismantling of an industrial building, metal scrap, in the form of various diameter pipes, structural I-beams, channels, angles, sheet metal plates and the like, must be efficiently severed and handled by heavy-duty metal shears. Such shears can also be utilized for reducing automobiles, truck frames, railroad cars and the like. The shears must be able to move and cut the metal scrap pieces regardless of the size or shape of the individual scrap pieces and without any significant damage to the shears. In the demolition of an industrial building, concrete crushing devices such as a concrete pulverizer or concrete crackers, are also used to reduce the structure to manageable components which can be easily handled and removed from the site. Wood shears and plate shears also represent specialized cutting devices useful in particular demolition or debris removal situations depending on the type of scrap. Also, a grapple is often utilized where handling of debris or work pieces is a primary function of the equipment. Historically, all of these pieces of equipment represent distinct tools having significant independent capital cost. Consequently, the demolition industry has tended to develop one type of tool that can be used for as many of these applications as possible.

For illustrative purposes, the following discussion will be directed to metal shears. One type of metal shear is a shear having a fixed blade and a movable blade pivoted thereto. The movable blade is pivoted by a hydraulic cylinder to provide a shearing action between the blades for severing work pieces. Examples of this type of shears can be found in prior U.S. Pat. Nos. 4,403,431; 4,670,983; 4,897,921; 5,926,958; and 5,940,971 which are assigned to the assignee of this application and which are herein incorporated in their entirety by reference.

FIG. 1 illustrates a prior art, multiple tool attachment adapted to demolition or construction equipment such as a backhoe (not shown). The multiple tool attachment is adapted to connect one of a series of tools or tool units to the demolition equipment. The tool attached in FIG. 1 is a metal shear 10. The shear 10 includes a first blade 12 connected to an upper jaw 13 and a second blade 14 connected to a lower jaw 15 wherein the jaws 13, 15 are pivotally connected at a hub or main pin 16 to a universal body 18. The body 18 is referred to as universal because it remains common to a series of tools or tool units in the attachment system. The universal body 18 is comprised of sides 19, a bearing housing 20 and a cylinder housing 21. A rotary coupling 23 is between the bearing housing 20 and the cylinder housing 21. The rotary coupling 23 allows for a rotation of the remaining portions of the universal body 18 relative to the bearing housing 20 and the associated demolition equipment. Essentially, the rotary coupling 23 allows for 360° rotation for angular orientation of the universal body 18 and the associated tool such as shear 10. A motor (not shown) is attached to the bearing housing 20 and geared to the rotary coupling 23 for rotationally positioning the universal body 18.

A first linkage 24 is pivotally connected at a removable pivot pin 26 to the first blade 12 and a second linkage 28 is pivotally connected at a removable pivot pin 30 to the second blade 14. The first linkage 24 and the second linkage 28 are pivotally connected to a slide member 32 at a common pivot pin 34. The slide member 32 is attached to a piston rod on a double-acting hydraulic cylinder 38 (partially obscured). The slide member 32 is movable within a slot 44. The hydraulic cylinder 38 is pivotally attached to the universal body 18 through a trunnion 40. Additional details of this arrangement are described in U.S. patent application Ser. No. 10/089,481 filed on Mar. 28, 2002, which is assigned to the same entity as the present application and which is hereby incorporated by reference.

Pressurized hydraulic fluid must be transferred through the rotary coupling 23 to operate the hydraulic cylinder 38. As illustrated in FIGS. 2 and 2A, a manifold 50 is connected to a hydraulic cylinder 38 wherein the manifold 50 is in fluid communication with the hydraulic cylinder 38 but, furthermore, these two parts are permitted to rotate relative to one another by providing the appropriate fluid channels between the manifold 50 and the hydraulic cylinder 38. This technology is known in the art.

A long-standing problem of hydraulic systems utilizing hydraulic cylinders with double-acting pistons exists when the range of motion of a particular tool is large and the forces imparted by the hydraulic cylinder must also be large. One technique for imparting large forces in a hydraulic system is to provide high-pressure fluid against the working surface of a double-acting piston. However, providing such high-pressure fluid may require an inordinately large hydraulic pump or, in the alternative, a smaller pump that provides sufficient pressure but at a lower flow rate. A large pump not only consumes valuable space but, additionally, may be expensive while a smaller pump, because of the lower flow it provides, takes a longer time to operate the double-acting piston. As an example, with a typical industrial metal shear, the time to extend the double-acting piston of a hydraulic cylinder may be six seconds while the time to retract the double-acting piston may be three seconds. The retraction process is faster because the area in which hydraulic fluid may flow within the retraction chamber is smaller than the area within the extension chamber because the piston rod within the retraction chamber consumes area. As a result, an amount of fluid in the retraction chamber will displace the piston a greater amount than the same amount of fluid in the extension chamber. Typically, the retraction time may be twice as fast as the extension time.

A design is needed which speeds up the extension time of the double-acting piston without sacrificing the force provided by the double-acting piston when necessary.

BRIEF SUMMARY OF THE INVENTION

The invention is directed to a manifold which provides pressurized hydraulic fluid in a hydraulic system used for engaging and disengaging construction or demolition equipment. The hydraulic system has a reservoir, a pump and reciprocating hydraulic cylinder with a double-acting piston. The hydraulic cylinder has an extension chamber and a retraction chamber. The manifold is comprised of a block having an extension passageway adapted to be in fluid communication with the extension chamber of the hydraulic cylinder. The extension passageway has an extension chamber port and a fluid supply port. The manifold also has a retraction passageway adapted to be in fluid communication with the retraction chamber of the hydraulic cylinder. The retraction passageway has a retraction chamber port and a fluid discharge port. A regeneration passageway connects the extension passageway and the retraction passageway with a check valve therein permitting flow in a single direction from the retraction passageway to the extension passageway to augment flow into the extension chamber from the retraction passageway.

The invention is also directed to a method which provides pressurized hydraulic fluid in a hydraulic system used for engaging and disengaging a tool attachment on construction or demolition equipment. The system has a reservoir, a pump and reciprocating hydraulic cylinder with a double-acting piston therein defining an extension chamber and a retraction chamber. The method comprises the steps of: a) providing fluid under pressure to the extension chamber through an extension passageway adapted to be in fluid communication with the extension chamber of the hydraulic cylinder, wherein the extension passageway has an extension chamber port and a fluid supply port; b) discharging fluid from the retraction chamber through a retraction passageway adapted to be in fluid communication with the retraction chamber of the hydraulic cylinder, wherein the retraction passageway has a retraction chamber port and a fluid discharge port; and c) providing a regeneration passageway connecting the extension passageway and the retraction passageway to permit flow in a single direction from the retraction passageway to the extension passageway to augment fluid flow into the extension chamber.

The invention is also directed to a hydraulically operated system for use with tool attachments on demolition and construction equipment utilizing the manifold discussed herein.

DETAILED DESCRIPTION OF THE INVENTION

Figure 1:
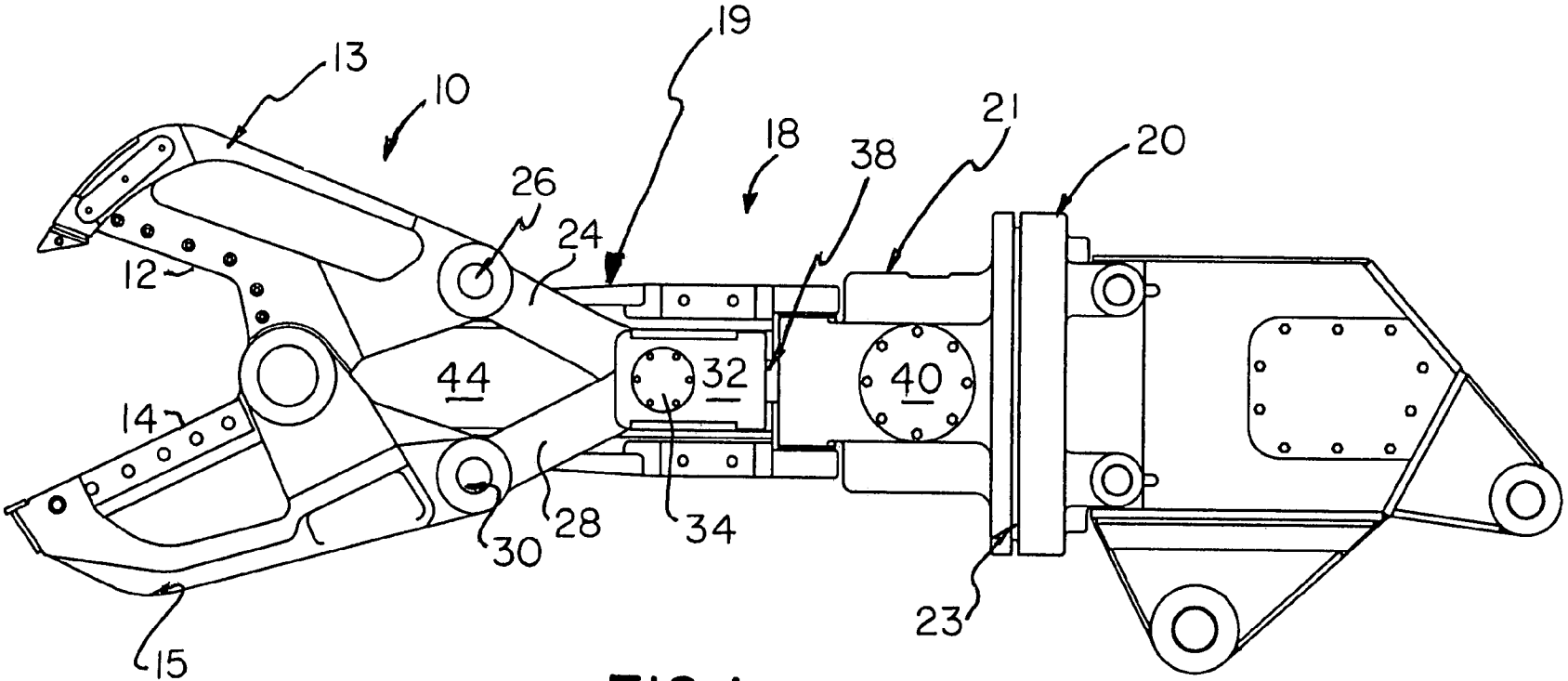
FIG. 1 PRIOR ART
FIG. 1 is prior art and is a side view illustrating a metal shear incorporated into a universal body for a construction tool.
Figure 2A:
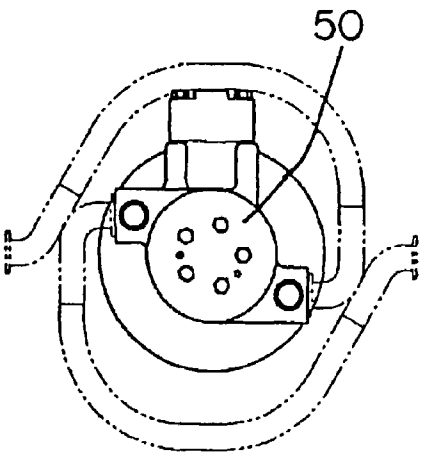
FIG. 2A PRIOR ART
FIG. 2A is an end view of the cylinder/manifold illustrated in FIG. 2.
Figure 2:
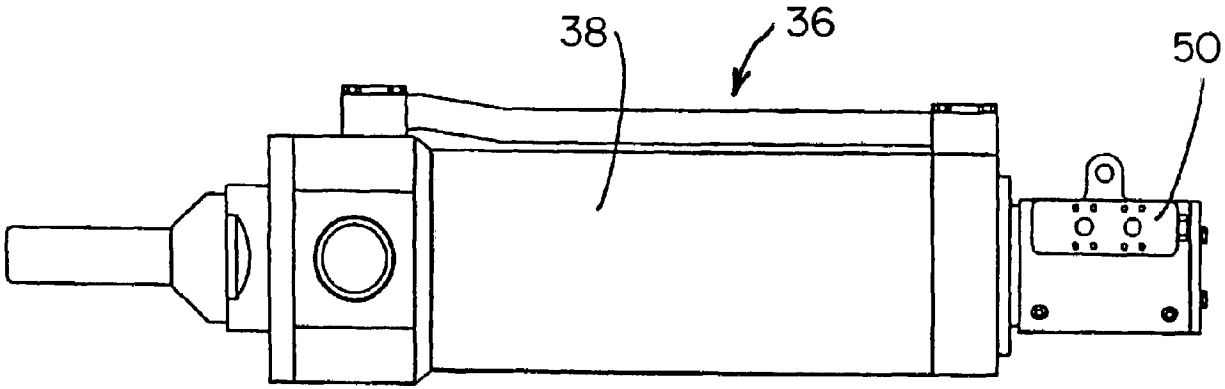
FIG. 2 PRIOR ART
FIG. 2 is prior art and is a side view of a hydraulic cylinder housing a dual acting piston.

For purposes of the description hereinafter, the terms "upper", "lower", "right", "left", "vertical", "horizontal", "top", "bottom" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The inventors have discovered that a large portion of the travel of a piston rod occurs with no load or very little load such that, regardless of the size of the hydraulic cylinder, a much lower pressure is needed to extend the double-acting piston. Nevertheless, somewhere along the stroke of the double-acting piston, the load will substantially increase whether as the result of the pressure required for a shear to cut a piece of metal or for a backhoe to overcome a large obstacle, and it is only at that time that increased pressure is necessary to provide a greater force on the piston.

Figure 3:
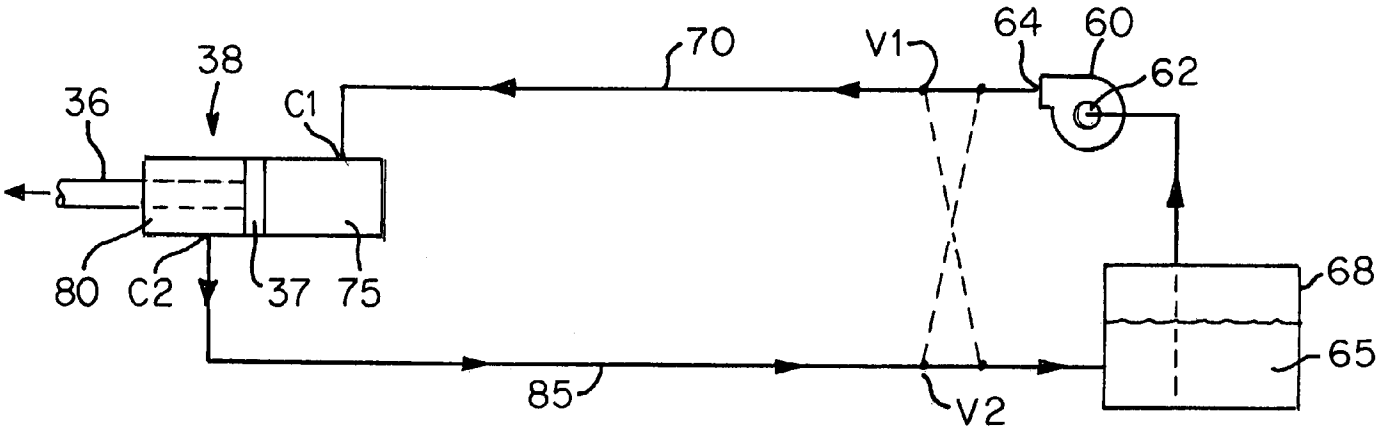
FIG. 3 PRIOR ART
FIG. 3 is prior art and is a schematic illustrating the fluid flow necessary to position the double-acting piston in the extended position.

Directing attention to FIG. 3, which is prior art and illustrates a schematic of fluid flow necessary to extend a double-acting piston 37, a pump 60 has a pump inlet 62 in fluid communication with fluid 65 within a reservoir 68. An extension passageway 70 is attached to the pump outlet 64 and travels to an extension chamber 75 of the hydraulic cylinder 38. As fluid is pumped, the extension chamber 75 fills up, thereby displacing the piston 37 to the left and displacing the piston rod 36 to the left. Simultaneously, fluid in a retraction chamber 80 is displaced from the hydraulic cylinder 38 through a retraction passageway 85 where it is then returned to the reservoir 68. In a typical design, the pressure within the extension passageway 70 may be approximately 2,500 psi when performing an operation while the pressure within the retraction passageway 85 may be as low as 100 psi. Typical systems in the past have utilized a pump 60 capable of providing a high pressure but doing so over a relatively long period of time such that although the double-acting piston 37 generates sufficient force to perform an operation, the time required to fill the extension chamber 75 may be as much as twice the amount of time to fill the retraction chamber 80.

Figure 4:
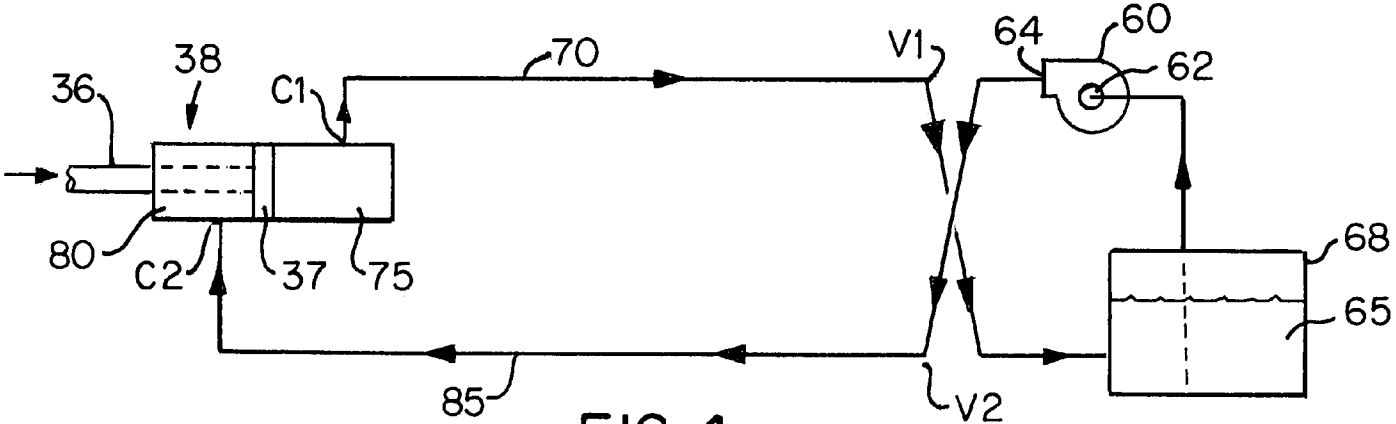
FIG. 4 PRIOR ART
FIG. 4 is prior art and is a schematic illustrating the fluid flow necessary to position the double-acting piston in the retracted position.

FIG. 4 is prior art and illustrates a schematic of the fluid flow for the retraction cycle. Pump 60 is again used; however, the pump outlet 64 is now switched such that the fluid 65 from the reservoir 68 is pumped into the retraction passageway 85 and into the retraction chamber 80 thereby displacing the piston 37 and the associated piston rod 36 to the right. Fluid is discharged through the extension passageway 70 where it is returned to the reservoir 68. This retraction process is typically not done under load and, as a result, much lower pressures are required. Additionally, because the area within the retraction chamber 80 is less than the area within the extension chamber 75 for the same amount of hydraulic fluid, the piston 37 will retract in a shorter time than the time to extend.

Realizing that in the extension mode the piston rod 36 may encounter a load only during a portion of its travel, the inventors have now provided a system and a method for filling the extension chamber 75 at a much faster rate when the piston rod 36 is not under load and then providing the necessary high pressure at a slower, controlled rate at the time the piston rod 36 encounters a load.

Figure 5:
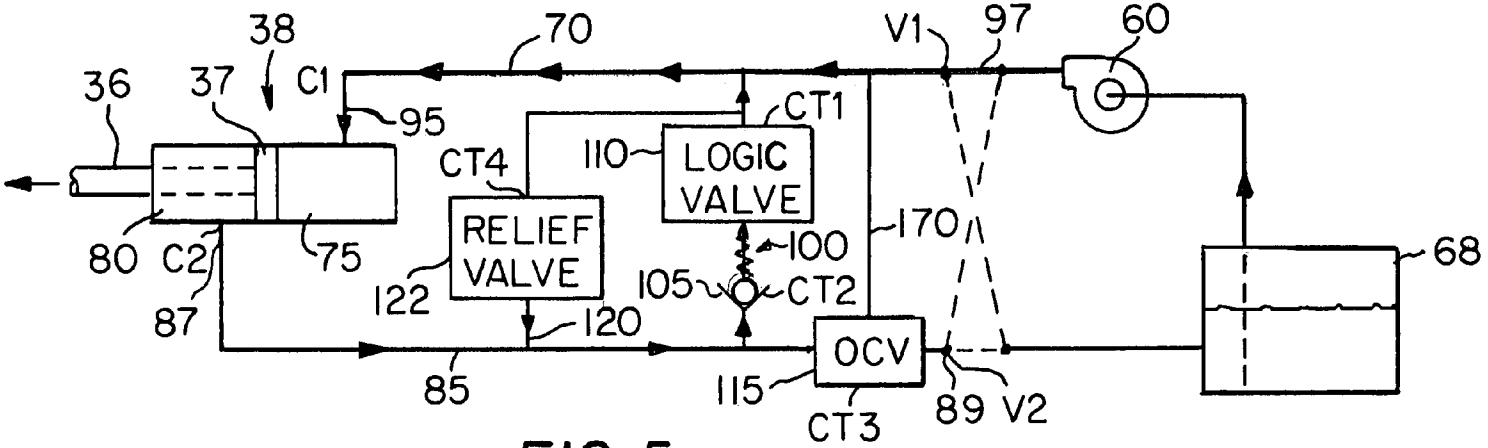
FIG. 5 is a schematic illustrating the fluid flow to position the double-acting piston in the extended position with the assistance of the regeneration feature in accordance with the subject invention.

Generally speaking, and with attention to FIG. 5, this is achieved through the introduction of a regeneration cycle blended within the prior art cycles for providing fluid to the extension chamber 75 to extend the piston rod 36 by rerouting the fluid discharged from the retraction chamber 80 as the rod 36 is extended. Rather than returning this discharge fluid to the reservoir 68 through the retraction passageway 85, the fluid is redirected to the extension passageway 70, thereby providing fluid from both the extension passageway 70 and the retraction passageway 85 into the extension chamber to accelerate filling of the chamber and, as a result, decrease the time for the extension chamber 75 to become filled.

As described herein, the passageways and hardware associated with this apparatus in one embodiment are located within a manifold 90 (FIG. 8) associated with the hydraulic cylinder 38. Further attention will be directed to this manifold 90. However, while the arrangement hereinafter is described within the confines of a manifold, it should be appreciated that the arrangements of the parts herein should not be limited thereto.

In particular, FIG. 5 illustrates the schematic of the fluid flow and the hardware associated with the extension of double-acting piston rod 36.

Figure 8A:
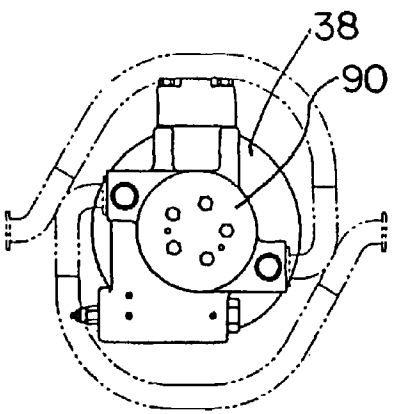
FIG. 8A is an end view of the cylinder/manifold illustrated in FIG. 8.
Figure 8:
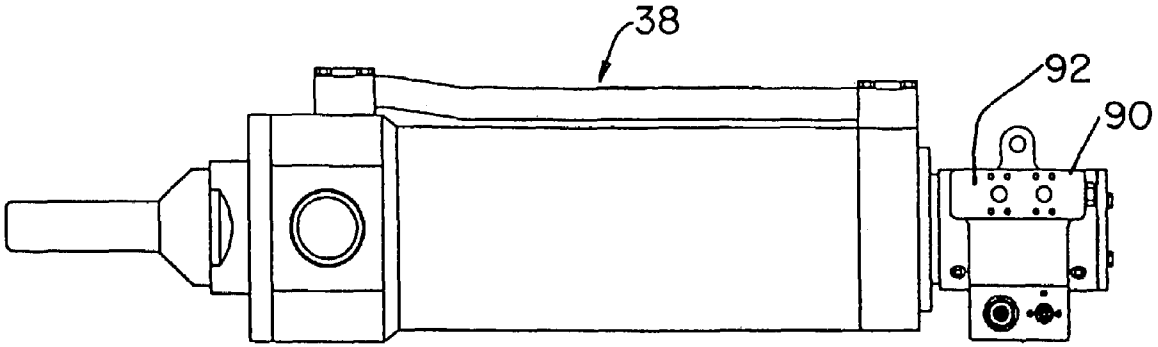
FIG. 8 is a side view of a hydraulic cylinder having attached thereto a manifold in accordance with the subject invention.

Directing attention to FIG. 5, which illustrates an extension mode with regeneration, the hydraulic system is comprised of a reservoir 68, a pump 60, and a reciprocating hydraulic cylinder 38 with a double-acting piston 37 therein defining an extension chamber 75 and a retraction chamber 80. A manifold 90 (FIG. 8) housing the hydraulic components discussed herein may be comprised of a block 92 having an extension passageway 70 (FIG. 5) adapted to be in fluid communication with the extension chamber 75 of the hydraulic cylinder 38. The extension passageway 70 has an extension chamber port 95 and a fluid supply port 97. For purposes of defining the bounds of the manifold 90, the indicators C1, C2, V1 and V2, have been used to identify ports within the manifold 90. As illustrated in FIG. 8, the block 92 of the manifold 90 is secured directly to and is flush with the housing of the hydraulic cylinder 38.

The manifold 90 further includes a retraction passageway 85 adapted to be in fluid communication with the retraction chamber 80 of the hydraulic cylinder 38. The retraction passageway 85 has a retraction chamber port 87 and a fluid discharge port 89. A regeneration passageway 100 connects the extension passageway 70 and the retraction passageway 85 with a check valve 105 therein. This arrangement permits flow in a single direction from the retraction passageway 85 to the extension passageway 70 to augment flow into the extension chamber 75 from the retraction passageway 85. In other words, the fluid flow into the extension chamber 75 during the extension cycle with regeneration is the combined fluid flow from the extension passageway 70 and the retraction passageway 85. This increased fluid flow greatly decreases the amount of time required to fill the extension chamber 75 and thereby extend the piston rod 36 when there is no load placed upon the rod 36.

More particularly, a first logic valve 110, or first valve, is placed in series with the check valve 105 within the regeneration passageway 100. The check valve 105 may be pre-loaded to require a minimum upstream pressure for activation such that during the extension cycle with regeneration (FIG. 5), the fluid within the retraction passageway 85 must have a minimum pressure to pass through the regeneration passageway 100.

During operation of the regeneration cycle, fluid flows from the pump 60 into the extension passageway 70 and into the extension chamber 75, thereby causing the double-acting piston 36 to move to the left toward the extended position.

Additionally, a control valve 115, or second valve, is placed in series with the retraction passageway 85 and is located between the regeneration passageway 100 and the fluid discharge port 89. A pressure sensing passageway 170 extends from the extension passageway 70 to the control valve 115. The control valve 115 is normally open and is closed when the pressure within the pressure sensing passageway 170 exceeds a set point such as, for example, 2,500 psi.

During the regeneration cycle illustrated in FIG. 5, the only fluid pressure required is that required to displace the piston rod 36 to the left and to advance the associated tool until a substantial load is encountered.

As an example, a typical operating pressure for cutting, using a metal shear, in construction or demolition equipment would be well in excess of 2,500 psi. However, the fluid pressure required to move the shear blades from the extended position to a retracted position just prior to cutting is much less than 2,500 psi.

For so long as no load is encountered, the pressure within the extension passageway 70 is relatively low and the control valve 115 remains closed. As a result, fluid discharged from the retraction chamber 80 travels through the retraction passageway 85 and into the regeneration passageway 100. The fluid pressure is sufficient to overcome the pre-load on the check valve 105. First logic valve 110 is normally open so that fluid freely flows through the first logic valve 110 and into the extension passageway 70.

As a result, the entire fluid flow from the retraction chamber 80 is diverted through the regeneration passageway 100 directly back to the extension passageway 70 to supply the extension chamber 75 with the combined fluid flow directly from the pump 60.

The regeneration cycle will continue only until the rod 36 encounters a load. At this time, the pump 60 will continue pumping and the pressure within the extension passageway 70 will increase.

Figure 6:
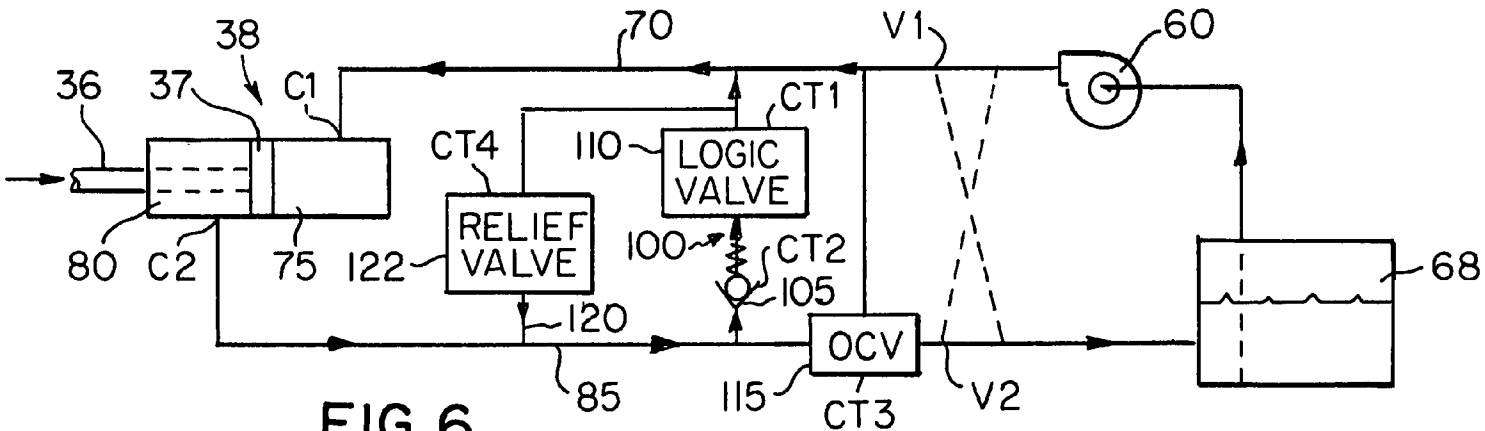
FIG. 6 is a schematic illustrating the fluid flow to apply maximum force to position the double-acting piston in the extended position.

Directing attention to FIG. 6, once the pressure in the extension passageway 70 exceeds the set point pressure of the control valve 115, which is communicated to the control valve 115 through the pressure sensing passageway 170, the control valve 115 opens, allowing fluid to return to the reservoir 68. The pre-load of the check valve 105 will prevent fluid from traveling through the regeneration passageway 100. The opening of the control valve 115 marks the end of the regeneration cycle and the beginning of the power cycle.

In the power cycle, as the pressure builds up within the extension passageway 70, the control valve 115 opens wider and permits more fluid to evacuate into the reservoir 68. Additionally, pressure builds from the extension passageway 70 within the regeneration passageway 100 to keep the check valve 105 closed.

A pressure relief valve 122 is connected between the first logic valve 110 and the retraction passageway 85 through pressure relief passageway 120. When the pump 60 is shut off, there will be high pressure fluid retained in the extension passageway 70. The relief valve 122 bleeds off high pressure fluid from the extension passageway 70 through the pressure relief passageway 120, into the retraction passageway 85, and into the reservoir 68. The relief valve 122 has a small bleed plug so that the fluid flow through the pressure relief valve 122 is low to dissipate pressure in the extension passageway 70 slowly.

As a result, under little or no load, as illustrated in FIG. 5, the rod 36 may be extended quickly utilizing the combined fluid flow from both the extension passageway 70 and the retraction passageway 85. At such time as the rod 36 encounters a load, as illustrated in FIG. 6, the extension cycle will no longer include regeneration and fluid will flow directly from the pump 60 through the extension passageway 70 and into the extension chamber 75 at an increased pressure.

Figure 7:
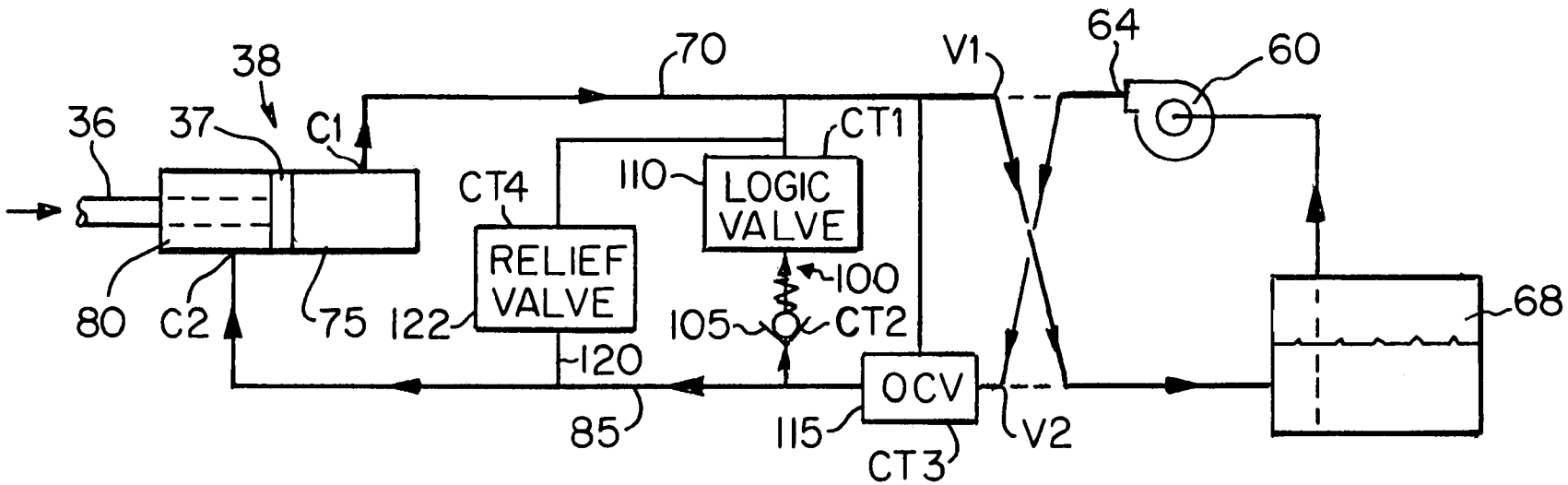
FIG. 7 is a schematic illustrating the fluid flow to position the double-acting piston in the retracted position.
Figure 11A:
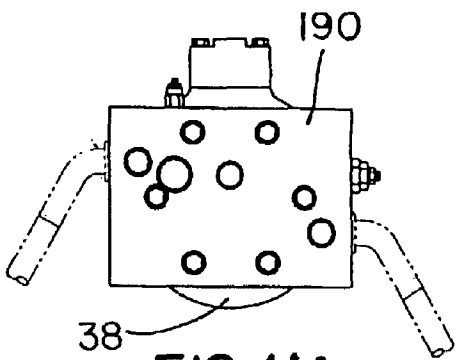
FIG. 11A is an end view of the cylinder/manifold illustrated in FIG. 11.

Directing attention to FIG. 7, in the retraction cycle, the fluid flow is essentially reversed from the fluid flow of the extension cycle. In particular, the outlet 64 of the pump 60 is directed to the retraction passageway 85 and the retraction chamber 80 is filled with fluid, thereby urging the piston 37 and the piston rod 36 to the right. The control valve 115 permits free flow in the direction from the pump 60 to the retraction chamber 80. Also, the fluid within the extension chamber 75 is directed along the extension passageway 70 and routed back to the reservoir 68. While pressure in the retraction passageway 85 may pop open the check valve 105 and try to flow past the first logic valve 110, pressure within the retraction passageway 85 extends into the pressure relief passageway 120 keeping the relief valve 122 closed, thereby keeping the first logic valve 110 closed and not permitting fluid to pass through the first logic valve 110 into the extension passageway 70. Fluid returning from the extension chamber 75 through the extension passageway 70 cannot go into the first logic valve 110 because it is held closed by pressure in the retraction passageway 85 via pressure in the pressure relief passageway 120 and the pressure relief valve 122. Fluid traveling through the extension passageway 70 then returns to the reservoir 68.

So far, this cycle has been described with reference to a schematic illustrating flow paths and hardware. In one preferred embodiment of the subject invention, the hardware and passageways between the hydraulic cylinder 38, pump 60, and reservoir 68 may be contained within a manifold 90 which may be connected directly to the hydraulic cylinder 38 as illustrated in FIG. 8.

Figure 9:
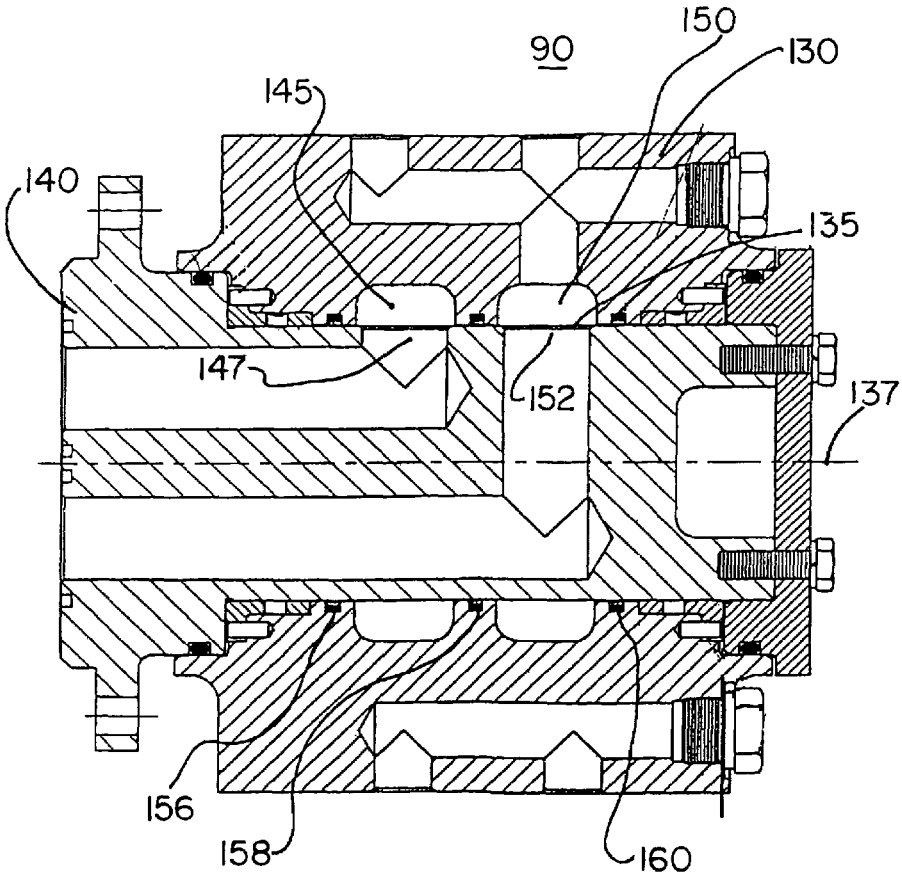
FIG. 9 is a sectional view of the manifold with a rotating horn extending therein.

FIG. 9 illustrates a cross-sectional view of the manifold 90 illustrated in FIG. 8. The manifold 90 includes a swivel attachment comprised of a non-rotating base 130 with a bore 135 extending therein and having a central axis 137. The non-rotating base 130 is secured to the body of, for example, the metal cutting shear. Within the bore 135 is a rotating cylindrical horn 140 which is secured to the back end of the hydraulic cylinder 38 (FIG. 8). Fluid is communicated between the base 130 and the horn 140 through fluid couplings between the base 130 and the horn 140 to permit the horn 140 to rotate about the central axis 137 while at the same time having fluid communication established between the base 130 and the horn 140. As illustrated in FIG. 9, such fluid communication is done utilizing hollow annular rings 145, 150 which circumscribe ports 147, 152 extending through the horn 140. Seals 156, 158, 160 are recessed within the bore 135 and contact the horn 140 to prevent fluid from escaping in the region. The horn 140 rotates against the bore 135.

Prior art designs in which a hydraulic manifold operated a cylinder and in which the cylinder was rotatable relative to the manifold required the use of hoses and hose connections. FIG. 9 shows a unique arrangement that allows the manifold 90 to be bolted directly to the rotatable housing 39 of the cylinder 38. In the past, the manifold 90 was not connected directly to the housing 39 but was connected through hoses and hose couplings to the manifold 90.

Figure 10:
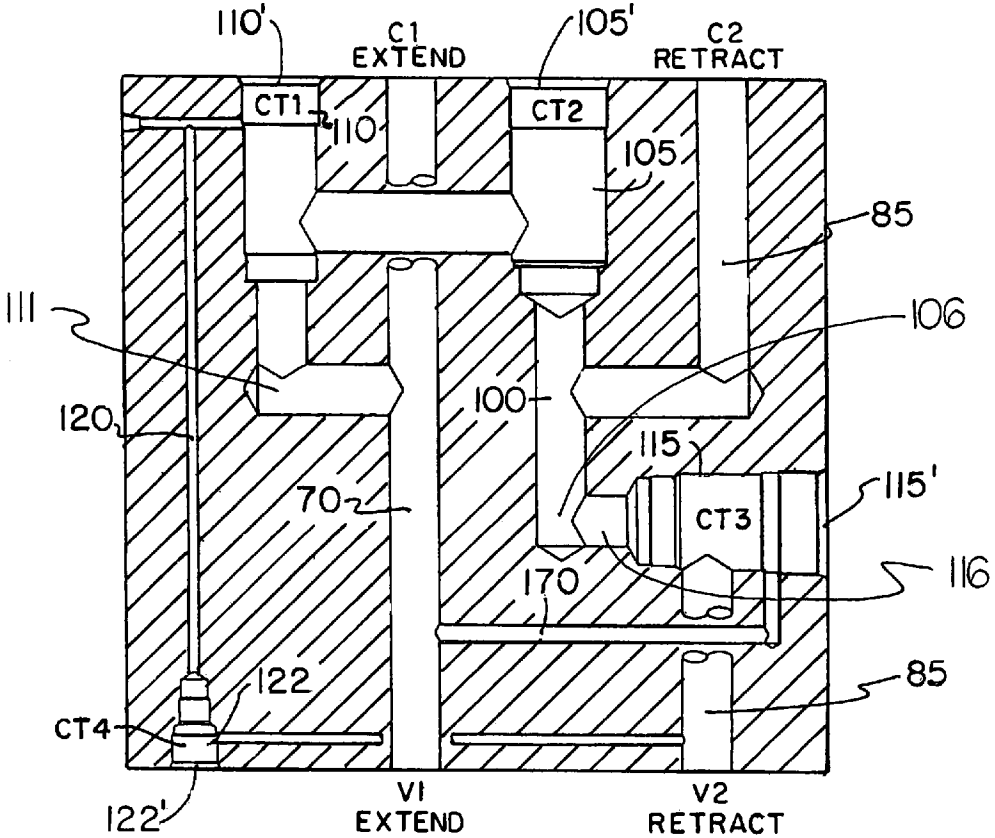
FIG. 10 is a schematic drawing of the passageways extending through the manifold in accordance with the subject invention.

FIG. 10 illustrates a layout of the passageways and valve locations for the manifold 90 described herein. In particular, the location for the port C1, C2, V1, V2 illustrated in FIG. 10 for the manifold 90 is also indicated on each of FIGS. 5, 6 and 7. Briefly restating, and with respect to FIGS. 5 and 10, in the extension mode with regeneration, fluid from the pump 60 enters port V1 of the manifold 90 (fluid supply port 97 in FIG. 5) and proceeds through the extension passageway 70 and out the port C1 (extension chamber port 95 in FIG. 5) into the extension chamber 75. Simultaneously, fluid from the retraction chamber 80 enters the manifold 90 at port C2 (retraction chamber port 87 in FIG. 5) and travels through the retraction passageway 85 where it is blocked by the control valve 115 and diverted into the regeneration passageway 100 through the check valve 105 and the first logic valve 110 where it is then introduced into the extension passageway 70.

The manifold layout illustrated in FIG. 10 does not show the particular valves but does illustrate the installation cavities associated with such valves. In particular, the installation cavities associated with check valve 105, first logic valve 110, control valve 115 and relief valve 122 are indicated as prime numbers 105', 110', 115', 122'. The directions of the passageways associated with the check valve cavity 105', the first logic valve cavity 110', and the control valve cavity 115' change abruptly in the region proximate to each of these valves, as illustrated by bends 106, 111, and 116.

Figure 11:
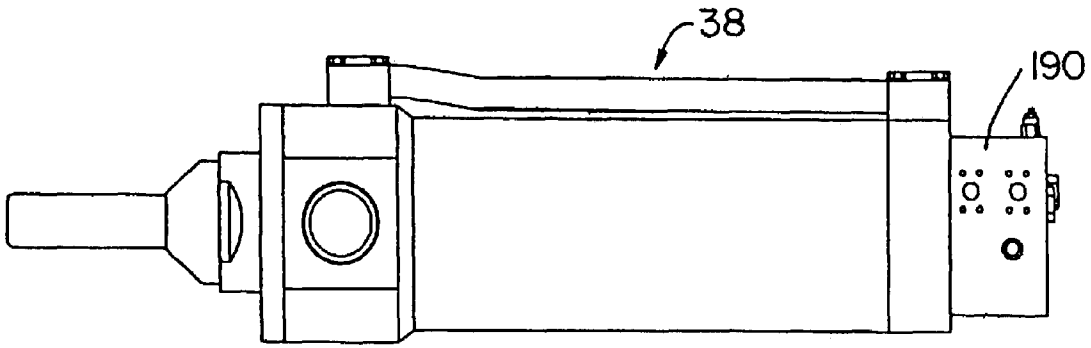
FIG. 11 is a side view of the hydraulic cylinder with a manifold attached thereto without a swivel attachment.

Although FIGS. 8 and 9 are directed to a manifold 90 having a swivel arrangement whereby a cylindrical horn 140 may rotate therein, it is entirely possible as illustrated in FIG. 11 for the manifold 190 to be attached directly to the hydraulic cylinder 38 such that there is no relative rotation between the parts.

Directing attention to FIGS. 5 and 10, details of the hardware will now be provided. Each of the valves discussed herein is a cartridge valve that fits within the respective installation cavity. The check valve 105 is a typical preloaded check valve. The first logic valve 110 is activated by pressure. The control valve 115 is an over center valve. The pressure relief valve 122 is a typical pressure relief valve.

Finally, the invention is directed to a hydraulically operated system for use with tool attachments on demolition and construction equipment comprising, with attention again directed to FIG. 5, a reservoir 68 filled with fluid 65 and a hydraulic cylinder 38 with a reciprocating double-acting piston 37 therein defining an extension chamber 75 and a retraction chamber 80. The double-acting piston 37 drives a rod 36 which is connected to a tool attachment such as, for example, the jaws illustrated in FIG. 1. A pump 60 moves fluid between the extension chamber 75 or the retraction chamber 80 of the hydraulic cylinder 38 and the reservoir 68 to pressurize the extension chamber 75 to extend the rod 36 and to pressurize the retraction chamber 80 to retract the rod 36. A manifold 90 (FIG. 8) as described herein is fluidly connected to the reservoir 68 and the chambers 75, 80 of the hydraulic cylinder 38 for directing fluid therebetween.

The system further includes a swivel attachment (FIG. 9) between the hydraulic cylinder 38 and the pump 60 that permits the cylindrical horn 140 to rotate within a non-rotatable base 130. Additionally, and directing attention to FIG. 11, the manifold 190 may be non-rotatably secured to the hydraulic cylinder 38. By attaching the manifold 190 directly to the hydraulic cylinder 38 the need for hoses is eliminated. This provides a design with fewer connection joints and higher reliability since typically hoses are a weak link in hydraulic systems.

The invention has been described with reference to the preferred embodiments. Obvious modifications and alterations will occur to others upon reading and understanding the preceding detailed description. It is intended that the invention be construed as including all such modifications and alterations.

The invention claimed is:

1. A manifold for providing pressurized hydraulic fluid in a hydraulic system used for engaging and disengaging construction or demolition equipment, wherein the system has a reservoir, a pump and reciprocating hydraulic cylinder with a double-acting piston therein defining an extension chamber and a retraction chamber, wherein the manifold is comprised of a block having:

a) an extension passageway adapted to be in fluid communication with the extension chamber of the hydraulic cylinder, wherein the extension passageway has an extension chamber port and a fluid supply port;

b) a retraction passageway adapted to be in fluid communication with the retraction chamber of the hydraulic cylinder, wherein the retraction passageway has a retraction chamber port and a fluid discharge port;

c) a regeneration passageway connecting the extension passageway and the retraction passageway with a check valve therein permitting flow in a single direction from the retraction passageway to the extension passageway to augment flow into the extension chamber from the retraction passageway; and d) wherein the block further includes a swivel attachment comprised of a non-rotating base with a bore extending therein and having a central axis extending therethrough and wherein a cylindrical horn is mounted within the bore such that the horn may rotate within the base thereby providing a manifold with a rotating block.

2. The manifold according to claim 1, further including:

a) a first valve in series with the check valve within the regeneration passageway, wherein the first valve permits unrestricted flow in the direction from the retraction passageway to the extension passageway; and b) second valve in series with the retraction passageway and located between the regeneration passageway and the fluid discharge port and wherein the second valve is selected to open at or above a predetermined set point pressure and to close otherwise.

3. The manifold according to claim 2, wherein the first valve is a logic valve.

4. The manifold according to claim 2, wherein the second valve is an over center valve.

5. The manifold according to claim 2, further including a pressure relief passageway connecting the first valve and the retraction passageway with a pressure relief valve therein to permit pressure equalization over time between the extension passageway and the retraction passageway.

6. The manifold according to claim 5, wherein the pressure relief valve discharges to the retraction passageway.

7. The manifold according to claim 1, wherein the check valve is pre-loaded to require a minimum upstream pressure for activation.

8. A method for providing pressurized hydraulic fluid in a hydraulic system used for engaging and disengaging a tool attachment on construction or demolition equipment, wherein the system has a reservoir, a pump and reciprocating hydraulic cylinder with a double-acting piston therein defining an extension chamber and a retraction chamber, wherein the method comprises the steps of:

a) providing fluid under pressure to the extension chamber through an extension passageway adapted to be in fluid communication with the extension chamber of the hydraulic cylinder, wherein the extension passageway has an extension chamber port and a fluid supply port;

b) discharging fluid from the retraction chamber through a retraction passageway adapted to be in fluid communication with the retraction chamber of the hydraulic cylinder, wherein the retraction passageway has a retraction chamber port and a fluid discharge port; and c) providing a regeneration passageway connecting the extension passageway and the retraction passageway to permit flow in a single direction from the retraction passageway to the extension passageway to augment fluid flow into the extension chamber; and d) providing a pressure relief passageway connecting the first valve and the retraction passageway with a pressure relief valve therein to permit pressure equalization over time between the extension passageway and the retraction passageway.

9. The method according to claim 8, further including the step of, when the fluid pressure in the extension passageway is below a predetermined set point pressure, directing the fluid from the retraction passageway through the regeneration passageway and into the extension passageway to reduce the time required for the extension chamber to fill with fluid.

10. The method according to claim 8, further including the step of, when the fluid pressure in the extension passageway is at or above the set point pressure, directing the fluid through the retraction passageway to the exclusion of the regeneration passageway.

11. The method according to claim 8, wherein the step of providing a regeneration passageway connecting the extension passageway and the retraction passageway to permit flow in a single direction further comprises the step of providing a check valve within the regeneration passageway.

12. A hydraulically operated system for use with tool attachments on demolition and construction equipment comprising:

a) a reservoir filled with fluid;

b) a hydraulic cylinder with a reciprocating double-acting piston therein defining an extension chamber and a retraction chamber, wherein the double-acting piston drives a rod and the rod is connected to a tool attachment;

c) a pump for moving the fluid between the chambers of the hydraulic piston and the reservoir to pressurize the extension chamber to extend the rod and to pressurize the retraction chamber to retract the rod, wherein when one chamber is filling the other chamber is emptying; and d) a manifold fluidly connected to the reservoir and the chambers of the hydraulic cylinder for directing fluid therebetween, wherein the manifold is comprised of:

1) an extension passageway adapted to be in fluid communication with the extension chamber of the hydraulic cylinder, wherein the extension passageway has an extension chamber port and a fluid supply port;

2) a retraction passageway adapted to be in fluid communication with the retraction chamber of the hydraulic cylinder, wherein the retraction passageway has a retraction chamber port and a fluid discharge port; and 3) a regeneration passageway connecting the extension passageway and the retraction passageway with a check valve therein permitting flow in a single direction from the retraction passageway to the extension passageway to augment fluid flow into the extension chamber; and 4) a swivel attachment between the tool attachment and the pump, wherein the swivel attachment has a non-rotating base with a bore extending therein and a rotating cylindrical horn secured therein and having a central axis, wherein fluid is communicated between the base and the horn through fluid couplings between the base and the horn and wherein the swivel attachment permits the horn to rotate about the horn central axis.

13. A manifold for providing pressurized hydraulic fluid in a hydraulic system used for engaging and disengaging construction or demolition equipment, wherein the system has a reservoir, a pump and reciprocating hydraulic cylinder with a double-acting piston therein defining an extension chamber and a retraction chamber, wherein the manifold is comprised of a block having:

a) an extension passageway adapted to be in fluid communication with the extension chamber of the hydraulic cylinder, wherein the extension passageway has an extension chamber port and a fluid supply port;

b) a retraction passageway adapted to be in fluid communication with the retraction chamber of the hydraulic cylinder, wherein the retraction passageway has a retraction chamber port and a fluid discharge port;

c) a regeneration passageway connecting the extension passageway and the retraction passageway with a check valve therein permitting flow in a single direction from the retraction passageway to the extension passageway to augment flow into the extension chamber from the retraction passageway;

d) a first valve in series with the check valve within the regeneration passageway, wherein the first valve permits unrestricted flow in the direction from the retraction passageway to the extension passageway;

e) a second valve in series with the retraction passageway and located between the regeneration passageway and the fluid discharge port and wherein the second valve is selected to open at or above a predetermined set point pressure and to close otherwise; and f) a pressure relief passageway connecting the first valve and the retraction passageway with a pressure relief valve therein to permit pressure equalization over time between the extension passageway and the retraction passageway.

14. The manifold according to claim 13, wherein the pressure relief valve discharges into the retraction passageway.

15. A manifold for providing pressurized hydraulic fluid in a hydraulic system used for engaging and disengaging construction or demolition equipment, wherein the system has a reservoir, a pump and reciprocating hydraulic cylinder with a double-acting piston therein defining an extension chamber and a retraction chamber, wherein the manifold is comprised of a block having:

a) an extension passageway adapted to be in fluid communication with the extension chamber of the hydraulic cylinder, wherein the extension passageway has an extension chamber port and a fluid supply port;

b) a retraction passageway adapted to be in fluid communication with the retraction chamber of the hydraulic cylinder, wherein the retraction passageway has a retraction chamber port and a fluid discharge port;

c) a regeneration passageway connecting the extension passageway and the retraction passageway with a check valve therein permitting flow in a single direction from the retraction passageway to the extension passageway to augment flow into the extension chamber from the retraction passageway; and d) wherein the hydraulic cylinder has a housing and the block is secured directly to and is flush with the housing of the hydraulic cylinder.

16. A manifold for providing pressurized hydraulic fluid in a hydraulic system used for engaging and disengaging construction or demolition equipment, wherein the system has a reservoir, a pump and reciprocating hydraulic cylinder with a double-acting piston therein defining an extension chamber and a retraction chamber, wherein the manifold is comprised of a block having:

a) an extension passageway adapted to be in fluid communication with the extension chamber of the hydraulic cylinder, wherein the extension passageway has an extension chamber port and a fluid supply port;

b) a retraction passageway adapted to be in fluid communication with the retraction chamber of the hydraulic cylinder, wherein the retraction passageway has a retraction chamber port and a fluid discharge port;

c) a regeneration passageway connecting the extension passageway and the retraction passageway with a check valve therein permitting flow in a single direction from the retraction passageway to the extension passageway to augment flow into the extension chamber from the retraction passageway, and d) wherein the direction of the passageway associated with the check valve changes abruptly in the region proximate to that valve.

17. The manifold according to claim 16, wherein the block:

a) further includes a first valve in series with the check valve within the regeneration passageway, wherein the first valve permits unrestricted flow in the direction from the retraction passageway to the extension passageway;

b) further includes a second valve in series with the retraction passageway and located between the regeneration passageway and the fluid discharge port and wherein the second valve is selected to open at or above a predetermined set point pressure and to close otherwise; and c) wherein the direction of the passageway associated with at least one of the check valve, the first valve, and the control valve changes abruptly in the region proximate to that valve.

18. A manifold for providing pressurized hydraulic fluid in a hydraulic system used for engaging and disengaging construction or demolition equipment, wherein the system has a reservoir, a pump and reciprocating hydraulic cylinder with a double-acting piston therein defining an extension chamber and a retraction chamber, wherein the manifold is comprised of a block having:

a) an extension passageway adapted to be in fluid communication with the extension chamber of the hydraulic cylinder, wherein the extension passageway has an extension chamber port and a fluid supply port;

b) a retraction passageway adapted to be in fluid communication with the retraction chamber of the hydraulic cylinder, wherein the retraction passageway has a retraction chamber port and a fluid discharge port;

c) a regeneration passageway connecting the extension passageway and the retraction passageway with a check valve therein permitting flow in a single direction from the retraction passageway to the extension passageway to augment flow into the extension chamber from the retraction passageway;

d) a first valve in series with the check valve within the regeneration passageway, wherein the first valve permits unrestricted flow in the direction from the retraction passageway to the extension passageway; and e) a second valve in series with the retraction passageway and located between the regeneration passageway and the fluid discharge port and wherein the second valve is selected to open at or above a predetermined set point pressure and to close otherwise.

19. A hydraulically operated system for use with tool attachments on demolition and construction equipment comprising:

a) a reservoir filled with fluid;

b) a hydraulic cylinder with a reciprocating double-acting piston therein defining an extension chamber and a retraction chamber, wherein the double-acting piston drives a rod and the rod is connected to a tool attachment;

c) a pump for moving the fluid between the chambers of the hydraulic piston and the reservoir to pressurize the extension chamber to extend the rod and to pressurize the retraction chamber to retract the rod, wherein when one chamber is filling the other chamber is emptying; and d) a manifold fluidly connected to the reservoir and the chambers of the hydraulic cylinder for directing fluid therebetween, wherein the manifold is secured directly to and is flush with the tool attachment and does not permit relative rotation with the tool attachment and wherein the manifold is comprised of:

1) an extension passageway adapted to be in fluid communication with the extension chamber of the hydraulic cylinder, wherein the extension passageway has an extension chamber port and a fluid supply port;

2) a retraction passageway adapted to be in fluid communication with the retraction chamber of the hydraulic cylinder, wherein the retraction passageway has a retraction chamber port and a fluid discharge port; and 3) a regeneration passageway connecting the extension passageway and the retraction passageway with a check valve therein permitting flow in a single direction from the retraction passageway to the extension passageway to augment fluid flow into the extension chamber.

* * * * *

UNITED STATES PATENT AND TRADEMARK OFFICE

CERTIFICATE OF CORRECTION

PATENT NO. : 7,040,214 B2
APPLICATION NO. : 10/880758
DATED : May 9, 2006
INVENTOR(S) : Cossette et al.

It is certified that error appears in the above-identified patent and that said Letters Patent is hereby corrected as shown below:

Face of Patent, See Item (75), Inventors: "Marc A. Cossette, Poland, OH (US); John R. Ramun, 8243 N. Lima Rd., Poland OH (US) 44514" should be reversed and should read -- John R. Ramun, 8243 N. Lima Rd., Poland OH (US) 44514; Marc A. Cossette, Poland, OH (US) --

Signed and Sealed this

Thirtieth Day of January, 2007

JON W. DUDAS
*Director of the United States Patent and Trademark Office*